US005311257A

United States Patent [19]

Ishii et al.

[11] Patent Number: 5,311,257

[45] Date of Patent: May 10, 1994

[54] IMAGE FORMING APPARATUS

[75] Inventors: Yoshifumi Ishii, Daito; Yuichi Masui, Isehara, both of Japan

[73] Assignee: Mita Industrial Co., Ltd., Japan

[21] Appl. No.: 769,395

[22] Filed: Oct. 1, 1991

[30] Foreign Application Priority Data

Oct. 13, 1990 [JP] Japan ..... 2-274054

[51] Int. Cl.[5] ..... G03G 21/00

[52] U.S. Cl. ..... 355/209; 355/204

[58] Field of Search ..... 355/209, 243, 203, 204; 340/756, 758, 762, 765, 768

[56] References Cited

U.S. PATENT DOCUMENTS

| | | | |
|---|---|---|---|
| 4,543,643 | 9/1985 | Shibazaki et al. | 364/900 |
| 4,975,734 | 12/1990 | Mishima | 355/209 X |
| 5,008,712 | 4/1991 | Inuzuka et al. | 355/206 |
| 5,043,766 | 8/1991 | Oushiden et al. | 355/218 |

FOREIGN PATENT DOCUMENTS

| | | |
|---|---|---|
| 3706432 | 9/1987 | Fed. Rep. of Germany . |
| 2152222 | 7/1985 | United Kingdom . |

OTHER PUBLICATIONS

Patent Abstracts of Japan, vol. 7, No. 109 (P-196) May 12, 1983 & JP-A-58 031 346 (Ricoh K.K.) Feb. 24, 1983.

Patent Abstracts of Japan, vol. 13, No. 75 (P-831) Feb. 21, 1989 & JP-A-63 261 272 (Minolta Camera) Oct. 27, 1988.

Patent Abstracts of Japan, vol. 13, No. 75 (P-831) Feb. 21, 1989 & JP-A-63 261 273 (Minolta Camera) Oct. 27, 1988.

Patent Abstracts of Japan, vol. 13, No. 75 (P-831) Feb. 21, 1989 & JP-A-63 261 274 (Minolta Camera) Oct. 27, 1988.

Patent Abstracts of Japan, vol. 15, No. 67 (P-1167) Feb. 18, 1991 & JP-A-2 289 867 (Minolta Camera) Nov. 29, 1990.

*Primary Examiner*—Leo P. Picard
*Assistant Examiner*—Christopher Horgan
*Attorney, Agent, or Firm*—Beveridge, DeGrandi, Weilacher & Young

[57] ABSTRACT

An image forming apparatus comprises a copy number setting button for setting the number of copies, magnification setting button for setting the magnification, first storing memory for storing the set number of copies, second storing memory for storing the set magnification, a single display for selectively displaying the set number of copies and the set magnification, a display mode switching key for switching the display mode to the copy number display mode or the magnification display mode, and display mode control for switching the display mode on the basis of input by the above display mode switching key. There is also provided a clear key for clearing the set contents and clear control for clearing the set contents of the display mode currently set out of the copy number display mode and the magnification display mode when key input is provided by the above clear key. When key input is provided by the clear key, only the set contents of the display mode currently set out of the copy number display mode and the magnification display mode are cleared. Consequently, it is possible to clear only one of the number of copies and the magnification which is erroneously set. Therefore, the operation efficiency for setting the number of copies and the magnification is increased.

6 Claims, 4 Drawing Sheets

IMAGE FORMING APPARATUS

BACKGROUND OF THE INVENTION

1. Field of the Invention

The present invention relates generally to image forming apparatuses such as a copying machine, and more particularly, to an image forming apparatus having a display for displaying the number of copies as well as displaying the magnification.

2. Description of the Prior Art

Copying machines conventionally known include one having a display for displaying the number of copies as well as displaying the magnification (see Japanese Patent Laid-Open Gazette No. 246077/1987).

In this type of copying machine, there is provided a clear key for clearing, when the number of copies or the magnification is erroneously set, the set contents. The conventional copying machine is so adapted that both the number of copies and the magnification currently set are cleared when the clear key is depressed.

When copies are made using the above described conventional copying machine, an operator sets the number of copies and the magnification before the star of copying. It is assumed &hat the magnification is erroneously set when the magnification is set after setting the number of copies. In this case, the operator depresses the clear key so as to set the magnification again. Then, not only the magnification but also the number of copies already set is cleared. Consequently, the operator must set the number of copies already set again, so that the operation is laborious. On the other hand, it is assumed that the number of copies is erroneously set when the number of copies is set after setting the magnification. Also in this case, the operator must set the magnification already set again in the above described manner.

SUMMARY OF THE INVENTION

An object of the present invention is to provide an image forming apparatus capable of clearing only one of the number of copies and the magnification which is erroneously set and being high in operation efficiency for setting the number of copies and the magnification.

An image forming apparatus according to the present invention comprises copy number setting means for setting the number of copies, magnification setting means for setting the magnification, first storing means for storing the set number of copies, second storing means for storing the set magnification, a single display for selectively displaying the set number of copies and the set magnification, a display mode switching key for switching the display mode to a copy number display mode or a magnification display mode, display mode control means for switching the display mode on the basis of input by the above display mode switching key, a clear key for clearing the set contents, and clear control means for clearing only the set contents of the display mode currently set out of the copy number display mode and the magnification display mode when key input is provided by the above clear key.

A liquid crystal display or a light emitting diode type digital display, for example, is used as the display.

Immediately after the power starts to be turned on, the display mode is set to the copy number display mode, for example. There may be provided means for automatically switching the display mode to the copy number display mode when the state of the magnification display mode is continued for a predetermined time period.

Furthermore, there may be provided an all clear key for clearing both the number of copies and the magnification at one time, and all clear control means for clearing both the number of copies and the magnification when key input is provided by the all clear key.

In the image forming apparatus according to the present invention, when key input is provided by the clear key, only the set contents of the display mode currently set out of the copy number display mode and the magnification display mode are cleared. Consequently, it is possible to clear only one of the number of copies and the magnification which is erroneously set. Therefore, the operation efficiency for setting the number of copies and the magnification is increased.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Description is now made of an embodiment of the present invention with reference to the drawings.

Figure 1:
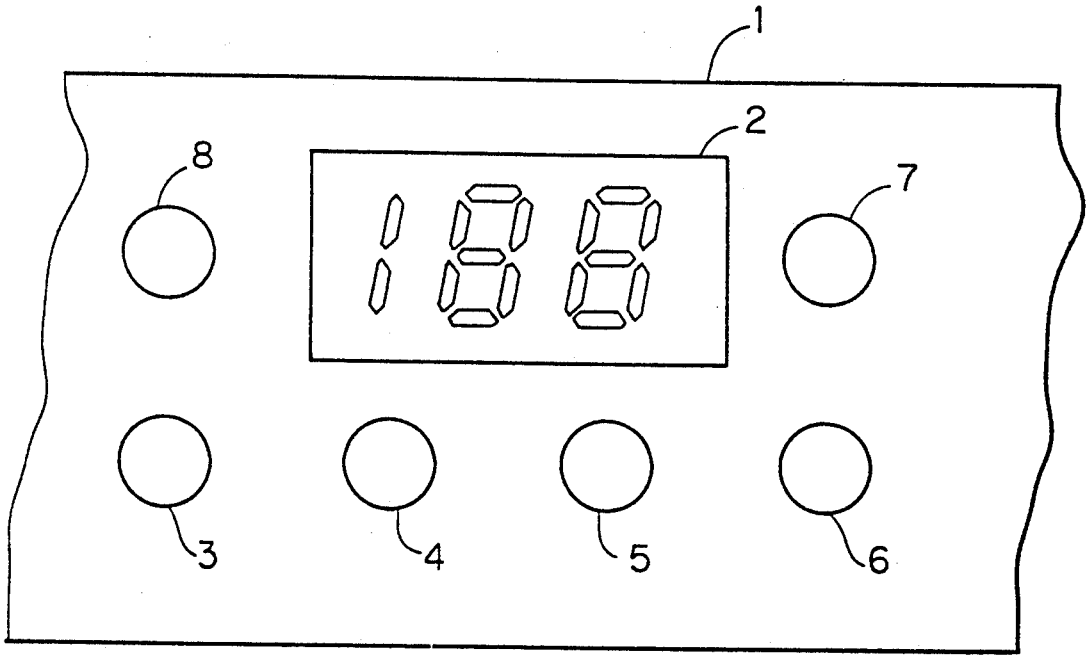
FIG. 1 is a partial front view showing a part of an operation panel.

FIG. 1 shows a display and various keys provided for an operation panel of a copying machine.

The operation panel 1 is provided with a display 2 for displaying the number of copies, the magnification and the like. The number of copies can be set in the range of 1 to 99 [sheets] and is represented by double figures on the display 2. The magnification can be set in the range of 62 to 141 [%] and is represented by three figures on the display 2. As the display 2, a light emitting diode type digital display, a liquid crystal display or the like is used.

A display mode switching key 3, a first copy number and magnification setting key 4, a second copy number and magnification setting key 5, a print key 6, a clear key 7, and an all clear key 8 are provided around the display 2.

The display mode switching key 3 is used for switching the display mode to a copy number display mode or a magnification display mode. When the display mode switching key 3 is depressed in a case where the display mode is the copy number display mode, the display mode is switched to the magnification display mode. On the other hand, when the display mode switching key 3 is depressed in a case where the display mode is the magnification display mode, the display mode is switched to the copy number display mode.

In this copying machine, immediately after the power is turned on, the display mode is the copy number display mode. In addition, when the magnification display mode is continued for more than a predetermined time period, the display mode is automatically switched to the copy number display mode.

The first copy number and magnification setting key 4 is used for inputting the tenth digit in the number of copies when the display mode is the copy number display mode, while bing used for changing the display value of the magnification to a higher one when the display mode is the magnification display mode.

The second copy number and magnification setting key 5 is used for setting the unit digit in the number of copies when the display mode is the copy number display mode, while being used for changing the display value of the magnification to a lower one when the display mode is the magnification display mode.

The print key 6 is used for starting a copying operation.

The clear key 7 is used for clearing only the set contents of the display mode currently set out of the copy number display mode and the magnification display mode.

The initial display value of the number of copies is "1", and the initial display value of the magnification is "100". When the number of copies is cleared, the initial value of the number of copies "1" is displayed on the display 2. On the other hand, when the magnification is cleared, the initial value of the magnification "100" is displayed on the display 2.

The all clear key 8 is used for clearing the number of copies and the magnification at one time.

Figure 2:
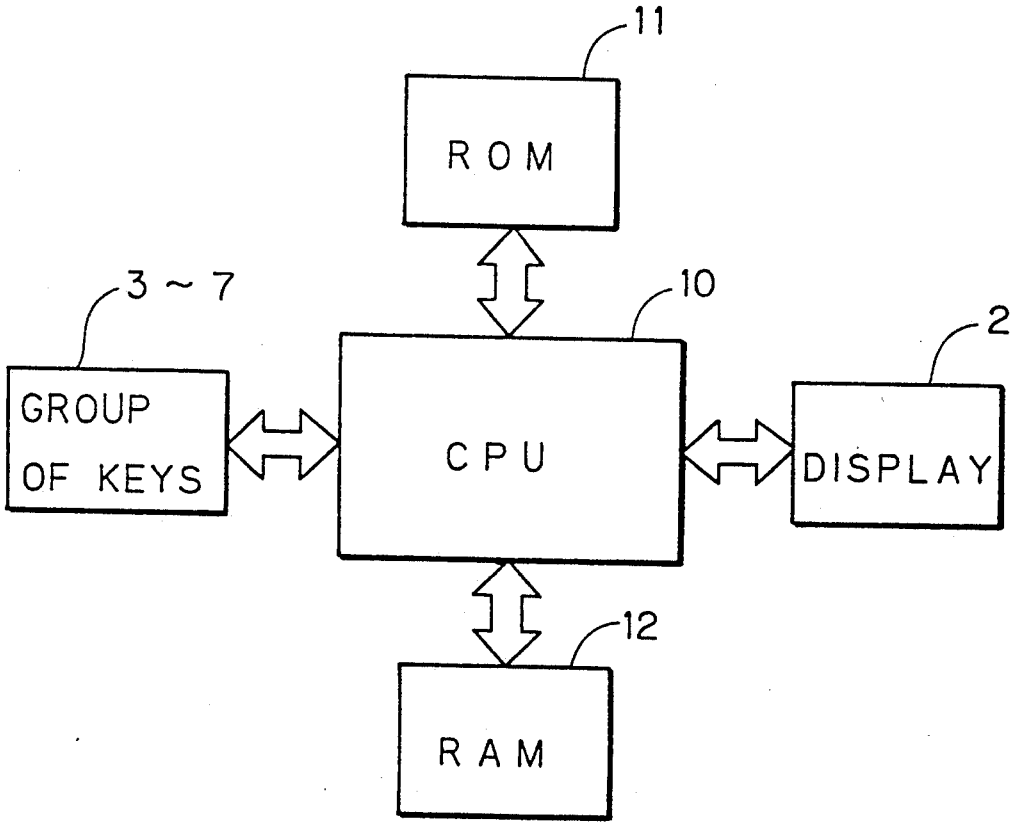
FIG. 2 is a block diagram showing the electrical construction of a copying machine.

FIG. 2 shows the electrical construction of the copying machine.

The copying machine is controlled by a CPU 10. The CPU 10 comprises a ROM 1 for storing its program and the like, and a RAM 12 for storing necessary data in addition to the set number of copies and the set magnification. The display 2, the above described keys 3 to 7, and other equipments (not shown) are connected to the CPU 10.

Figure 3A:
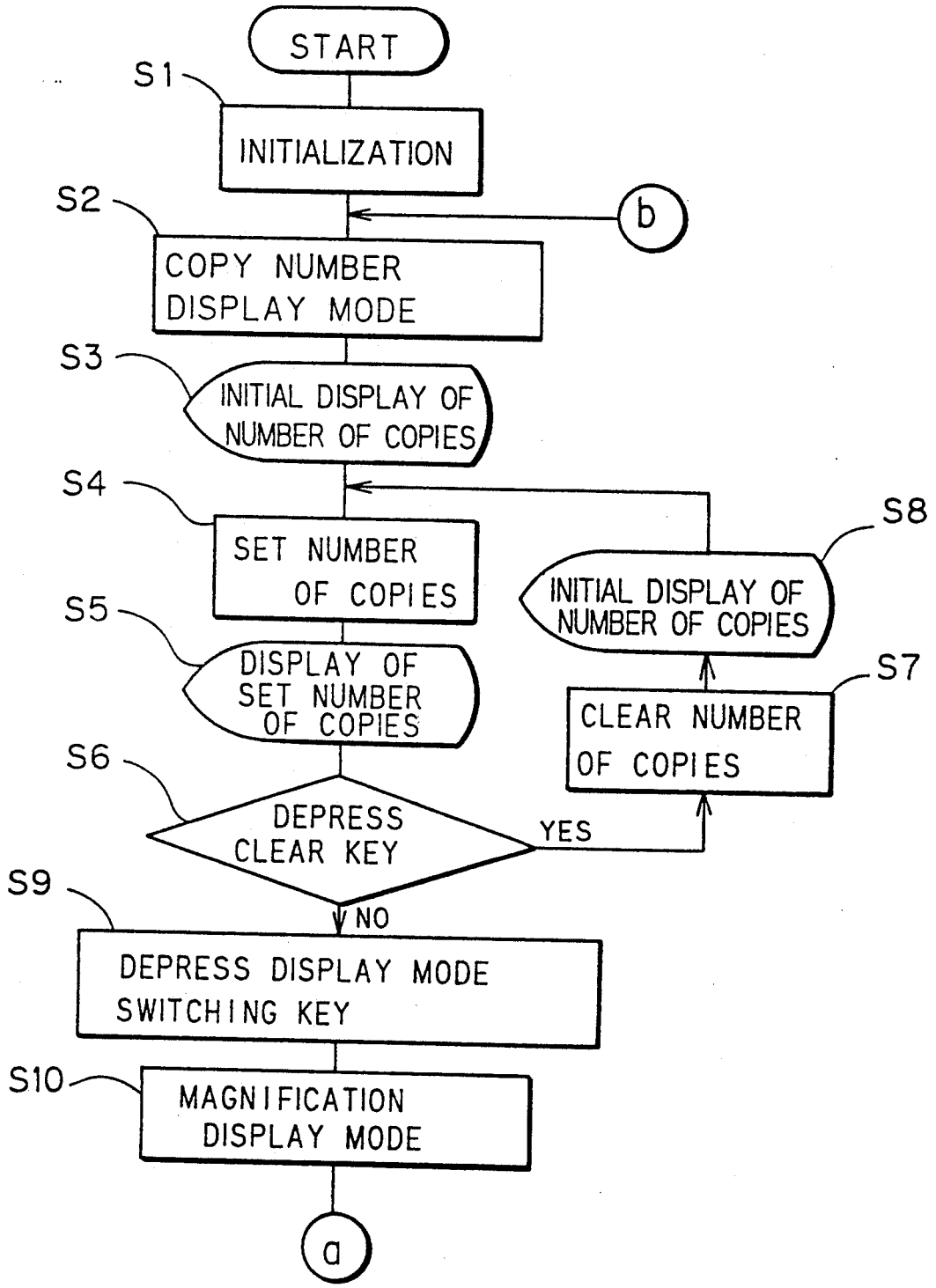
FIGS. 3*a* and 3*b* are flow charts showing the procedure for setting the number of copies and the magnification.
Figure 3B:
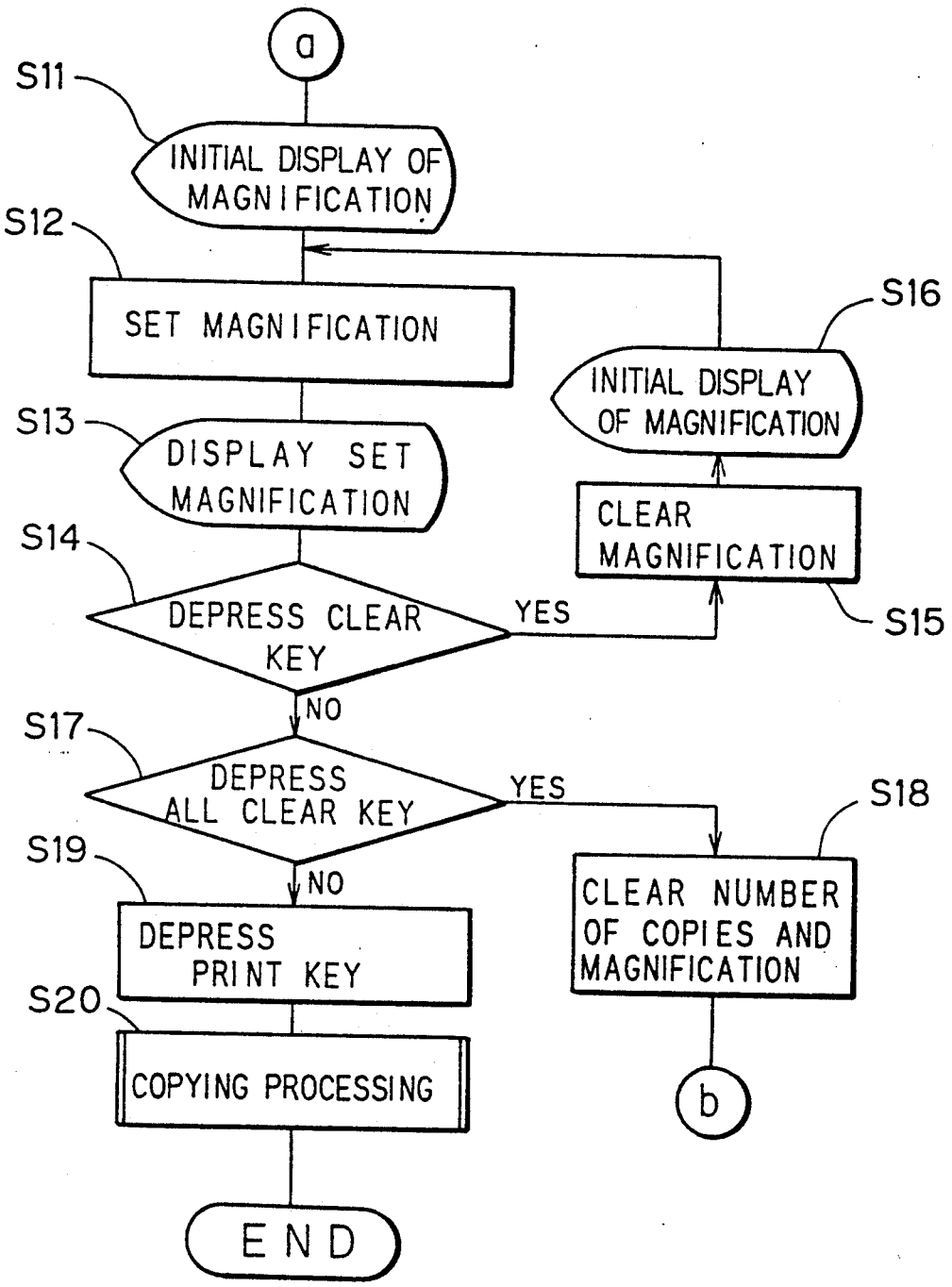

FIGS. 3*a* and 3*b* show the procedure for setting the number of copies and the magnification.

For convenience of illustration, description is now made of a case where the magnification is set after setting the number of copies.

When power for the copying machine is turned on, the program is initialized (step S1), so that the display mode is set to the copy number display mode (step S2). In this case, the initial value of the number of copies "1" is displayed on the display 2 (step S3).

Thereafter, when an operator operates the first copy number and magnification setting key 4 and the second copy number and magnification setting key 5 to set the number of copies (step S4), the set number of copies is stored in the RAM 12 and is displayed on the display 2 (step S5).

When the number of copies is erroneously set in the above described setting of the number of copies, the clear key 7 is depressed by the operator (step S6). Consequently, the number of copies stored in the RAM 12 is cleared and the number of copies displayed on the display 2 is cleared (step S7), and the initial value of the number of copies "1" is displayed on the display 2 (step S8). Thereafter, when the operator operates the first copy number and magnification setting key 4 and the second copy number and magnification setting key 5 to set the number of copies again (step S4), the number of copies set again is stored in the RAM 12 and is displayed on the display 2.

When the number of copies is correctly set, the display mode switching key 3 is depressed by the operator so as to set the magnification (step S9). Consequently, the display mode is switched to the magnification display mode (step S10), and the initial value of the magnification "100" is displayed on the display 2 (step S11).

Thereafter, when the operator operates the first copy number and magnification setting key 4 and the second copy number and magnification setting key 5 to set the magnification (step S12), the set magnification is stored in the RAM 12 and is displayed on the display 2 (step S13).

When the magnification is erroneously set in the setting of the magnification, the clear key 7 is depressed by the operator (step S14). Consequently, the magnification stored in the RAM 12 is cleared and the magnification displayed on the display 2 is cleared (step S15), and the initial value of the magnification "100" is displayed on the display 2 (step S16).

In this case, the number of copies already set is not cleared. More specifically, the number of copies already set remains stored and held in the RAM 12. After the magnification is cleared, when the operator operates the first copy number and magnification setting key 4 and the second copy number and magnification setting key 5 to set the magnification again (step S12), the magnification set again is stored in the RAM 12 and is displayed on the display 2 (step S13).

When the setting of the number of copies and the magnification is terminated, the print key 6 is depressed by the operator (step S19) Consequently, copying processing is performed (step S20).

After the magnification is set, when the operator finds that both the number of copies and the magnification are erroneously set, the all clear key 8 is depressed by the operator (step S17). Consequently, both the number of copies and the magnification which are stored in the RAM 12 are cleared (step S18). Then, the program is returned to the step S2. In the step S2, the display mode is set to the copy number display mode, so that the initial value of the number of copies "1" is displayed on the display 2 (step S3). Thereafter, the number of copies and the magnification are set again by the operator (steps S4 to S17).

Although description was made of a case where the magnification is set after setting the number of copies, it should be noted that the number of copies can be set after setting the magnification.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

copy number setting means for setting a number of copies for a copy operation;

magnification setting means for setting a magnification for said copy operation;

first storing means for storing the number of copies set by said copy number setting means;

second storing means for storing the magnification set by said magnification setting means;

a single display for selectively displaying the set number of copies and the set magnification;

a display mode switching key for providing key input for setting a display mode of said display to one of a copy number display mode or a magnification display mode;

display mode control means for setting the display mode on the basis of input by said display mode switching key; and a clear key for providing key input for causing clearing of the set number in said setting means which corresponds to the display mode in which said display has been set by said display control means; and clear control means for clearing only the contents of the storing means corresponding to the display mode in which said display has been set when clear key input is provided by said clear key.

2. The image forming apparatus according to claim 1, wherein the display mode is set to the copy number display mode immediately after power for said apparatus is turned on.

3. The image forming apparatus according to claim 1, which further comprises means for automatically switching the display mode to the copy number display mode after the magnification display mode has continued for a predetermined time period.

4. The image forming apparatus according to claim 1, which further comprises an all clear key for providing key input for causing clearing both the number of copies and the magnification at the same time, and all clear control means for clearing both the number of copies and the magnification when key input is provided by operation of the all clear key.

5. The image forming apparatus according to claim 1, wherein said display is a liquid crystal display.

6. The image forming apparatus according to claim 1, wherein said display is a light emitting diode type digital display.

* * * * *